US009285107B2

(12) United States Patent
Krijn et al.

(10) Patent No.: US 9,285,107 B2
(45) Date of Patent: Mar. 15, 2016

(54) RETROFIT LIGHTING DEVICE

(75) Inventors: Marcellinus Petrus Carolus Michael Krijn, Eindhoven (NL); Theodorus Johannes Petrus Van Den Biggelaar, Veldhoven (NL); Gabriel-Eugen Onac, Veldhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/124,084

(22) PCT Filed: Jun. 5, 2012

(86) PCT No.: PCT/IB2012/052824
§ 371 (c)(1),
(2), (4) Date: Dec. 5, 2013

(87) PCT Pub. No.: WO2012/168860
PCT Pub. Date: Dec. 13, 2012

(65) Prior Publication Data

US 2014/0133144 A1 May 15, 2014

(30) Foreign Application Priority Data

Jun. 10, 2011 (EP) ..... 11169471

(51) Int. Cl.

| | |
|---|---|
| ***F21V 23/04*** | (2006.01) |
| ***F21K 99/00*** | (2010.01) |
| ***F21V 3/00*** | (2015.01) |
| ***F21V 17/02*** | (2006.01) |
| *F21Y 101/02* | (2006.01) |
| *F21Y 113/00* | (2006.01) |
| *F21V 3/04* | (2006.01) |

(52) U.S. Cl.
CPC ..... *F21V 23/0485* (2013.01); *F21K 9/135* (2013.01); *F21K 9/56* (2013.01); *F21K 9/58* (2013.01); *F21V 3/00* (2013.01); *F21V 3/0418* (2013.01); *F21V 17/02* (2013.01); *F21V 23/0442* (2013.01); *F21V 3/0409* (2013.01); *F21V 3/0436* (2013.01); *F21Y 2101/02* (2013.01); *F21Y 2113/005* (2013.01)

(58) Field of Classification Search
CPC ..... F21K 9/56; F21K 9/58; F21K 9/135; F21V 3/00; F21V 3/0418; F21V 3/0409; F21V 3/0436; F21V 23/0442; F21V 23/0485; F21V 17/02; F21Y 2113/005; F21Y 2101/02
See application file for complete search history.

(56) References Cited

U.S. PATENT DOCUMENTS

| | | | | |
|---|---|---|---|---|
| 7,218,056 | B1 * | 5/2007 | Harwood | 315/86 |
| 7,597,455 | B2 * | 10/2009 | Smith et al. | 362/249.01 |
| 2003/0137844 | A1 | 7/2003 | Bucher et al. | |

(Continued)

FOREIGN PATENT DOCUMENTS

| | | | |
|---|---|---|---|
| CN | 201407618 | Y | 2/2010 |
| DE | 102011005051 | A1 | 9/2012 |

(Continued)

*Primary Examiner* — Thomas M Sember

(57) ABSTRACT

There is provided a lighting device (100) comprising at least one light source for providing light, a envelope encompassing said light source, a base to which said envelope is engaged, and a control means for adjusting the lighting settings of said lighting device. The control means are arranged for detecting a position in relation to the base of a point of reference being movably arranged on the lighting device. The lighting settings are adjusted in response to the detected position.

9 Claims, 4 Drawing Sheets

(56) References Cited

U.S. PATENT DOCUMENTS

| | | | | |
|---|---|---|---|---|
| 2006/0133075 | A1 | 6/2006 | Huang | |
| 2009/0086475 | A1 | 4/2009 | Caruso et al. | |
| 2009/0103293 | A1 | 4/2009 | Harbers | |
| 2011/0115413 | A1 | 5/2011 | Erickson et al. | |
| 2011/0115414 | A1 | 5/2011 | Ku et al. | |
| 2011/0287665 | A1* | 11/2011 | Chien | 439/638 |
| 2012/0161667 | A1* | 6/2012 | Mason et al. | 315/297 |

FOREIGN PATENT DOCUMENTS

| | | | |
|---|---|---|---|
| GB | 1307158 | A | 2/1973 |
| JP | 2007200723 | A | 8/2007 |
| TW | 200949143 | A | 12/2009 |
| WO | 2010006729 | A8 | 1/2010 |
| WO | 2010017523 | A1 | 2/2010 |
| WO | 2010064186 | A1 | 6/2010 |
| WO | 2010067291 | A2 | 6/2010 |
| WO | 2011007325 | A1 | 1/2011 |

* cited by examiner

RETROFIT LIGHTING DEVICE

FIELD OF THE INVENTION

The present invention relates to the field of retrofit lighting devices, and more particularly to a retrofit lighting device comprising control means for adjusting the lighting settings of the lighting device.

BACKGROUND OF THE INVENTION

Spectacular progress in the development of light emitting diodes, LEDs, has made LED-based lamps to compete with incandescent lamps, and within short a large part of the incandescent lamps will be replaced by retrofit LED lamps (not in the least due to legislation). LEDs offer several advantages over traditional light sources, such as long lifetime, high lumen efficacy, low operating voltage, small form factor (giving design flexibility), almost pure spectral colors, fast modulation of lumen output, and instant on.

In general, incandescent lamps as well as LED lamps are used in a mode in which they are either full-on or off. Retrofit LED lamps can be made to be dimmable by standard dimmer switches arranged for instance on a wall. However, in practice, only few lamps are connected to a dimmer switch in the home. Replacing ordinary switches by dimmer switches implies an effort in time and cost only few households are anticipated to make.

At the same time, there is a trend towards personalization of lighting. The problem is therefore that, despite this need for personalization of lighting, the present infrastructure allows only switching lamps on and off. Thus there is a need for providing an alternative manner of controlling the lighting settings of LED based lamps.

SUMMARY OF THE INVENTION

It is an object of the present invention to at least provide an alternative, user friendly and intuitive manner for adjusting the lighting settings of a lighting device.

This and other objects are achieved by providing a lighting device having the features defined in the independent claims. Preferred embodiments are defined in the dependent claims.

According to a first aspect of the inventive concept there is provided a lighting device comprising at least one light source for providing light, an envelope encompassing the light source, a base to which the envelope is engaged, and a control means for adjusting the lighting settings of the lighting device. The control means are arranged for detecting a position in relation to the base of a point of reference being movably arranged on the lighting device, and the lighting settings are adjusted in response to the detected position.

Thereby, there is provided a lighting device in which a current position in relation to the base of a movably arranged reference point on the lighting device itself is utilized for adjusting the lighting setting of the light source. Thus, no external dimmer, switch or remote control is needed for the user to control the lighting device, and thereby to change a current light effect obtained by the lighting device. A current light effect obtained by the lighting device may for instance be changed in response to moving the reference point by adjusting the lighting settings for light intensity from a high light level to a low light level accompanied by adjusting the color of the light from cool-white to warm-white, and vice versa.

Preferably, the lighting device is a retrofit LED lamp, i.e. the at least one light source comprises at least one light emitting diode. A LED lamp may in general refer to conventional semiconductor light-emitting diodes, to organic LEDs (OLEDs), or polymer light-emitting diode (PLED) devices. Advantageously, a LED lamp emits a major part of its input energy as light and does not generate much heat. It therefore remains cool, implying that the LED lamp can be touched during operation, contrary to an incandescent lamp which may waste up to 98% of its input energy producing heat. Further, other types of low heat generating light sources engaged in a retrofit lamp are applicable for a lighting device according to the present inventive concept.

The base of a retrofit LED lamp is typically connected to a cap for engaging with a socket. In an alternative embodiment of the lighting device, the base comprises a power source, like a battery. This enables the LED lamp to be in sleep mode while being able to respond to external, e.g. wireless, signals even when the LED lamp is switched off by its main switch on the wall.

According to an embodiment of the lighting device, the detected position is detected vertically, horizontally, or as a rotation about a central symmetry axis of the lighting device, or as any combination thereof. Thus, the change of the position of the reference point with respect to the base, which is the basis for adjusting the lighting settings, may be selected to be detected in a direction being vertical with respect to the base, horizontal with respect to the base, and as a rotation with respect to the base, or as any combination thereof. By detecting more than one direction of the position change, the degree of freedom when it comes to changing the light effect is increased. As an example, a change in the vertical direction may govern saturation of the light, while a change in the rotation may govern the hue of the light.

According to an embodiment of the lighting device, the adjusting of the lighting settings is done mechanically, which provides for a less complicated lighting device which does not have to include an electronic control circuitry. Further, integrating mechanical adjustment if the lighting settings in the lighting device, is possible to provide at low-cost. With a mechanical adjustment, the user gets haptic feedback, i.e. directly feels and visually perceives what happens when the lighting device is controlled.

According to an embodiment of the lighting device, the envelope is movably engaged with the base. This allows the envelope to be utilized as reference point in the lighting device. A user may then in an extremely intuitive manner control the lighting settings of the lighting device by simply changing the current position of the envelope. In this way a very simple and inexpensive user interface is obtained.

According to an embodiment of the lighting device, it further comprises a control element to which the reference point is associated. Thereby, the lighting settings are advantageously controlled by manipulating the control element.

According to an embodiment of the lighting device, the control element is one of a movable position element, a capacitive touch sensor, and a non-contact sensor.

According to an embodiment of the lighting device, when the control element is a movable position element, the movable position element is rotatably arranged between the envelope and the base.

According to an embodiment of the lighting device, wherein the movable position element is a chopper wheel, which provides a reliable and robust mechanical adjustment of the lighting device.

According to an embodiment of the lighting device, when the envelope is rotatably movable, the lighting device further comprises a stop mechanism for allowing at least one finite rotation angle for the rotation of the envelope.

According to an embodiment of the lighting device, when the control element is a capacitive touch sensor or non-contact sensor, the capacitive touch sensor or the non-contact sensor is arranged by means of a transparent conductor on an inner or outer side of the envelope. Preferably, the transparent conductor is provided by means of indium tin oxide, ITO, arranged on the envelope such that the sensing contact does not block the light from the lighting device.

According to an embodiment of the lighting device, the detected position is detected by means of a potentiometer.

According to an embodiment of the lighting device, when the detected position is detected as a rotation of the reference point with respect to the base, the lighting device further comprises at least one gear for transferring the rotation of the reference point to a rotation of the potentiometer. Thereby, an off-centre location of the potentiometer from a central symmetry axis of the lighting device about which the rotation is performed is made possible.

According to an embodiment of the lighting device, the envelope further comprises an inner envelope arranged for encompassing the light source.

According to an embodiment of the lighting device, an optical layer is arranged on the inner envelope, wherein the optical layer is one of a remote phosphor layer, a segmented remote phosphor layer, and a micro-structure. The micro structure may be for instance a number of micro-lenses to shape the orientation of the light leaving the envelope.

According to an embodiment of the lighting device, the envelope is releasably engaged with the base.

It is noted that the invention relates to all possible combinations of features recited in the claims.

BRIEF DESCRIPTION OF THE DRAWINGS

This and other aspects of the present invention will now be described in more detail, with reference to the appended drawings showing embodiment(s) of the invention.

DETAILED DESCRIPTION

Figure 1:
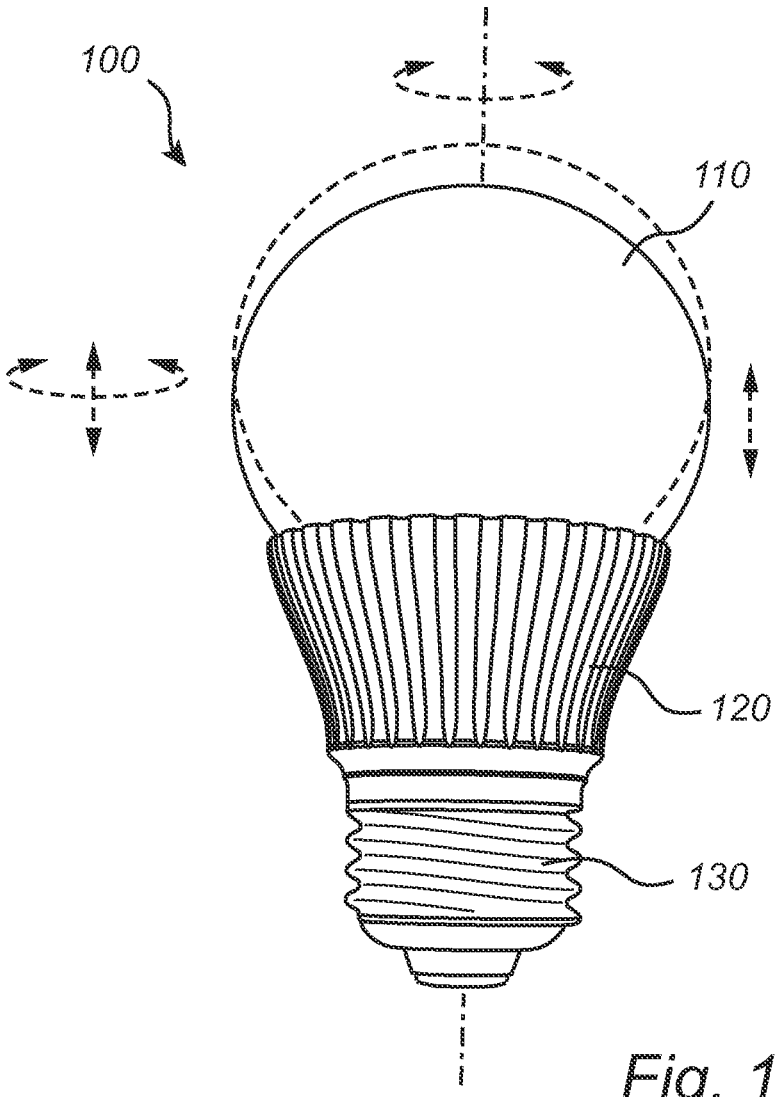
FIG. 1 is a perspective side view illustrating an embodiment of a lighting device according to the present inventive concept.

FIG. 1 is a perspective side view illustrating a lighting device 100 according the present inventive concept. The lighting device 100 comprises a cap 130 for engaging with a socket, a base, which here is a heat sink 120 for dissipating heat, and a bulb 110 which encompasses a light source (not visible). In the described embodiments, the envelope is bulb-shaped and therefore also referred to as bulb. However, the invention is not restricted to envelopes that are bulb-shaped; each envelope with the required functionality falls under the scope of the present invention. The bulb 110 is arranged such that it is movable with respect to the base 120, in that its vertical position in relation to the base 120 can be changed by pulling it out a predetermined distance from the heat sink, as illustrated by the dashed bulb in FIG. 1, and may subsequently be pushed back into an initial position. Further, the bulb 110 is rotatable about the center axis of the lighting device, such that its rotary position with respect to the heat sink 120 is allowed to change. The lighting device 100 further comprises a control unit (not visible) that in response to the current position of the bulb is arranged to adjust the lighting settings of the lighting device 100 in a predetermined manner, which may include adjusting a first set of lighting settings for when the bulb 110 is pushed or pulled, and adjusting a second set of lighting settings for when the bulb 110 is twisted.

Figure 2A:
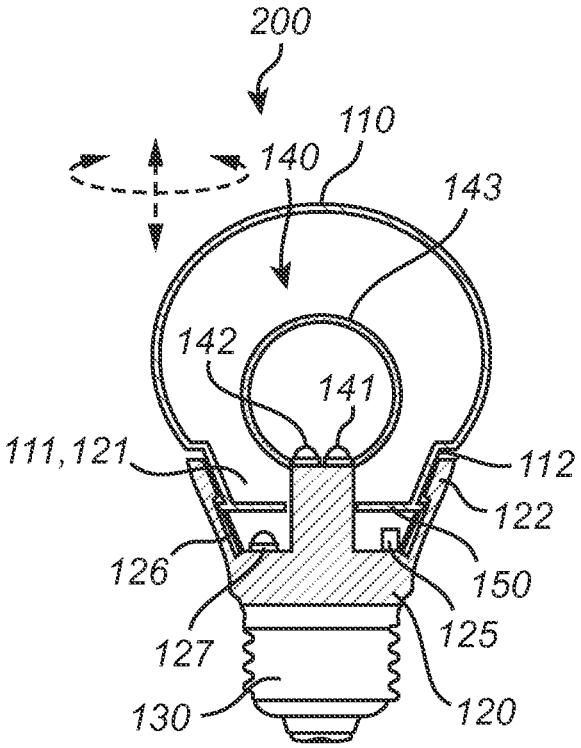
FIG. 2*a* is a schematic partly cross-sectional side view of an embodiment of a lighting device according to the present inventive concept.

FIG. 2*a*, details a schematic partly cut open side view of an embodiment of a lighting device 200 according to the present inventive concept. The lighting device 200 is here a retrofit LED lamp, which comprises a light source 140 arranged on a base 120. A bulb 110 is arranged to surround the light source 140 and is further at a lower portion 111 thereof engaged with a receiving portion 121 of the base 120. The bulb 110 is here a semi-transparent diffuser made of glass, but may be any suitable transparent or translucent glass, plastic or ceramic. The base 120 is mechanically attached to a cap 130 for engaging with a socket. The cap 130 includes driver and control circuitry (not shown) which is electrically connected to the light source 140 for providing power and lighting settings to the LEDs 141, 142. The base 120 is here further arranged to act as a heat sink. It is typically made in aluminum, or any other suitable heat conducting material. Optionally, the base and the cap are integrated into one element.

The light source 140 comprises a plurality of blue LEDs 142, amber emitting LEDs 141, and a transparent bulb 143 arranged to encompass the LEDs 141, 142. Further, a yellow emitting phosphor layer is deposited on the transparent bulb 143, such that part of the light emitted by the blue LEDs 141 is converted to yellow by the remote phosphor layer on the transparent bulb 143. The remainder of the blue light which is transmitted by the phosphor layer, in combination with the yellow light emitted by the phosphor layer mix and result in white light. By mixing the white light with light generated by the amber LEDs 141, a warmer color of the light outputted from the lighting device 200 via the bulb 110 can be obtained. In this manner, upon dimming the lamp by reducing the driver currents through the LEDs 141, 142, a lower light output can be accompanied by a warmer color, i.e. a lower color temperature, following the black-body-line. This is behavior reminiscent of incandescent lamps and advantageous as it provides, as conceived by most users, a cozier atmosphere upon dimming the lamp.

To continue, the bulb 110 is movably arranged with respect to the base 120. In this exemplifying embodiment, the bulb 120 has on its lower portion 111 a circumferential receiving slot 112 for receiving a corresponding circumferential protruding portion 122. The extension of the slot 121 is larger than the protruding portion 122, such that the bulb 110 is vertically displaceable with respect to the base 120 within a predetermined interval governed by the slot and the protruding portion. A spring 126 is arranged between the base 120 and the bulb 110 to govern the vertical displacement of the bulb 120. Further, a micro-switch 125, which is connected to the control circuitry of the lighting device, is arranged in the lower portion 126 of the base 120 to detect whether the bulb is pushed or pulled with respect to the base 120, i.e. to detect the vertical position of the bulb with respect to the base. In an alternative embodiment of the lighting device, the displacement of the bulb is governed by means of a piece of deformable material, e.g. an elastomer, arranged such that when the bulb is pushed or pulled with respect to the base, the deformable material is deformed and touches the micro-switch. In embodiments of the latter lighting device, the deformation of the material is measured by optical means or capacitive means.

According to an embodiment of the lighting device, the vertical position of the reference point, which in the example above is the bulb, is detected by a potentiometer.

Figure 2B:
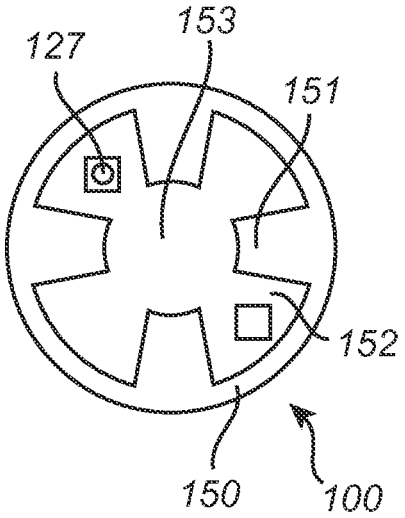
FIG. 2*b* is a cut open upper view showing a detail of the lighting device of FIG. 2*a,*

To continue with the lighting device 200, as described with reference to FIG. 2*a*, the bulb 110 is further arranged such that it can be twisted, i.e. rotated about the central symmetry axis of the lighting device 200. The amount of twist of the bulb 110 with respect to the base 120 is in this exemplifying example determined by a chopper wheel 150 which is attached to the bottom of the bulb 110. A cut open upper view of the lighting device 200 illustrating the chopper wheel 150 in more detail is provided in FIG. 2*b*. The chopper wheel 150 (which may in principle be made of any suitable opaque material) is provided with a central opening 153 arranged for receiving the light source 140, and is further provided with radially distributed cutout portions 152. Below the chopper wheel 150, and on the base 120, a photodiode 127 is arranged. Due to the cutout portions 152, and the remaining radially distributed opaque portions 151 of the chopper wheel 150, during rotation of the bulb 120, the associated rotation of the chopper wheel 120 modulates the amount of light (daylight or light generated by the light source 140) that can reach the photodiode 127. From the amount of light measured by the photodiode 127 and thereby detected by the control circuitry, the position of the chopper wheel 150 (and bulb 110), i.e. its rotation with respect to the base 120, can be derived.

Figure 3:
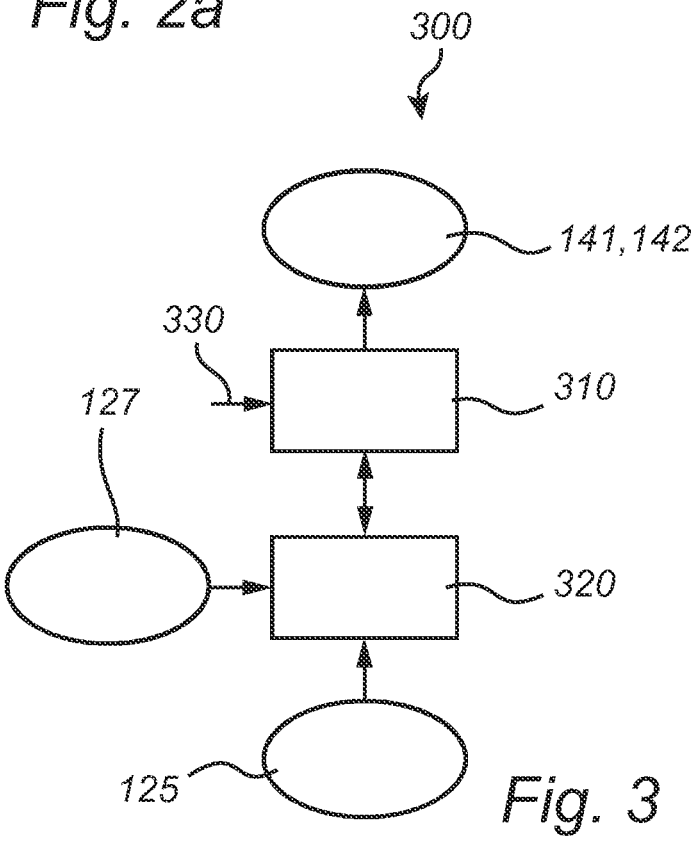
FIG. 3 is a schematic block diagram illustrating the control circuitry layout of the an embodiment of a lighting device according to the present inventive concept.

The control circuitry is arranged to adjust the lighting settings of the lighting device in response to the detected position. A simplified illustration of the control circuitry 200 according to lighting device 200 is shown in FIG. 3, which is a high-level schematic block diagram of the electronics layout. The control circuitry 300 comprises the LEDs 141, 142 which are electrically connected to the driver electronics 310, which is connected to some power source 330, typically being the mains. A microcontroller 320 is connected to the photo diode 127 and the micro-switch 125, and is therefore able to measure and process information regarding the vertical position of the bulb as well as the rotation of the bulb. The microcontroller 320 further comprises instruction to in response to the detected position of the bulb adjust the lighting settings of the LEDs, i.e. to control the driver electronics 310, such that a desired light effect of the lighting device 200 is achieved. The driver and control circuitry can, as mentioned above, be embedded in the cap 130 of the lighting device 200.

The control circuitry, as described above, adjusts the lighting settings of the lighting device by electrically controlling the light sources. However, according to embodiments of a lighting device according to the present inventive concept, the lighting settings are controlled mechanically, which will be described herein under with reference to FIG. 5.

According to an embodiment of the lighting device 200, the mode of operation of the lighting device 200 is the following: a counter-clockwise rotation of the bulb 110 (with the cap 130 of the lighting device oriented away from the viewer) changes the color from cool-white to warm-white (along a black-body curve) while at the same time reducing the lumen output. When subsequently rotating the bulb 110 clockwise, the color correspondingly changes from warm-white to cool-white.

Figure 4:
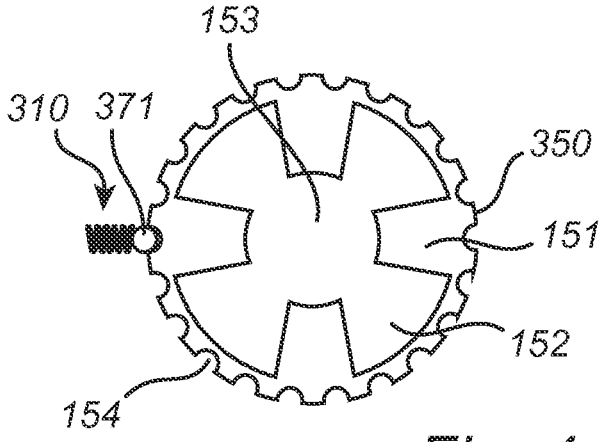
FIG. 4 is a schematic illustration of a detail in an embodiment of a lighting device according to the present inventive concept.

According to an embodiment of the lighting device, the device further comprises a stop mechanism for allowing a finite twist angle of the bulb. This is achieved by arranging the stop mechanism such that rotating or counter-rotating the bulb beyond a predetermined angle with respect to the base is prevented. In an exemplifying embodiment the stop mechanism is provided on the chopper wheel, which is illustrated in FIG. 4. FIG. 4 details a chopper wheel 350 for attaching to the lower portion of a bulb, which is provided with a central opening 153 arranged for receiving the light source and is further provided with radially distributed cutout portions 152 and radially distributed opaque portions 151 as described for the lighting device 200 above. The chopper wheel 350 is further provided with a raster click system, which enables presets of allowed angle positions of the bulb. Radially distributed recesses 154 arranged along the outer rim of the chopper wheel 350, which are arranged to receive a front portion 371 of a spring loaded element 310 attached to the side wall of the receiving portion of the base provides a discrete number of possible angle positions.

Figure 5:
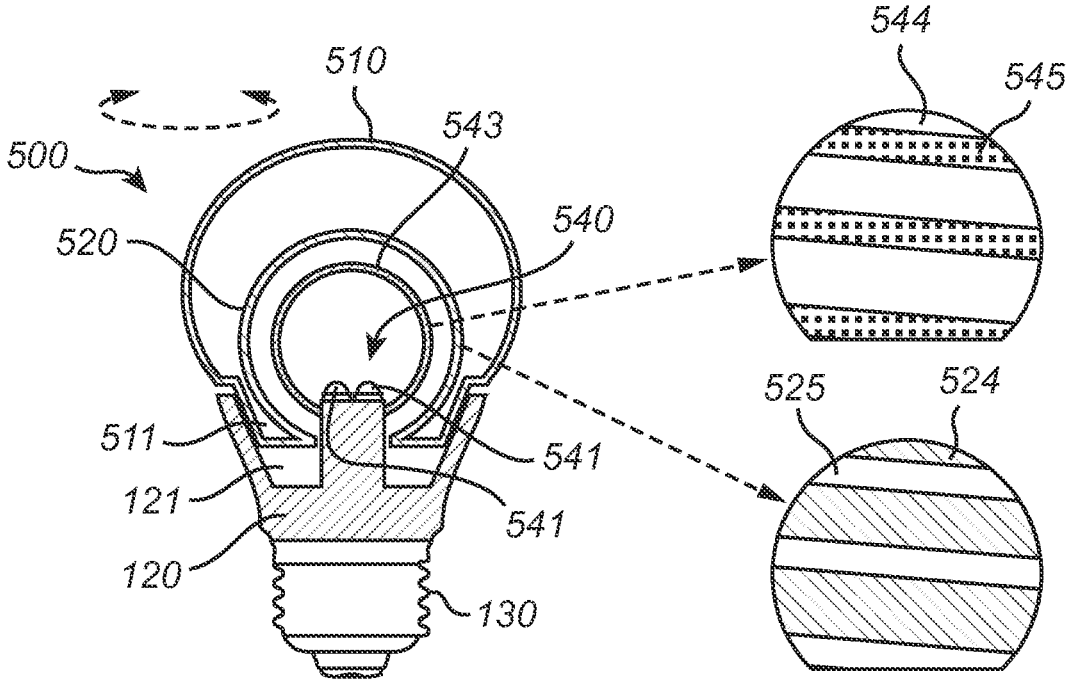
FIG. 5 is a schematic partly cross-sectional side view of an embodiment of a lighting device according to the present inventive concept.

According to an embodiment of the lighting device, described with reference to FIG. 5, the lighting device 500 is a retrofit LED lamp, which comprises a light source 540 comprising LEDs 541 emitting blue light which are arranged on a base 120, which here is a heat sink. A bulb 510 is arranged to surround the light source 540 and is further at a lower portion 511 thereof engaged with a receiving portion 121 of the base 120. The bulb 510 is here a semi-transparent diffuser made of glass. The base 120 is mechanically attached to a cap 130 for engaging with a socket, which cap 130 includes a driver (not shown) which is electrically connected to the light source 540 for providing power to the LEDs 541. The light source 540 further comprises a first spherical envelope 543 arranged to encompass the LEDs 541. The first spherical envelope 543 is a segmented transmitter/reflector bulb, which is segmented in a spiral shaped pattern of transparent and diffuse reflecting regions, 544, 545. Further, attached to the bulb 510 and encompassing the segmented transmitter/reflector bulb, i.e. spherical envelope 543, a second spherical envelope 520 that is segmented in a spiral shaped pattern of yellow and amber phosphor regions, 524, 525, is arranged.

Further, the bulb 510 is movably arranged with respect to the base 120. Upon twisting the bulb 510, the second spherical envelope 520 is rotated with respect to the first spherical envelope 543. As a result the amount of blue light passing regions with yellow phosphor compared to the amount of blue light passing regions with amber phosphor will change. Consequently, by twisting the bulb the color temperature of the light emitted by the lighting device changes.

Figure 6:
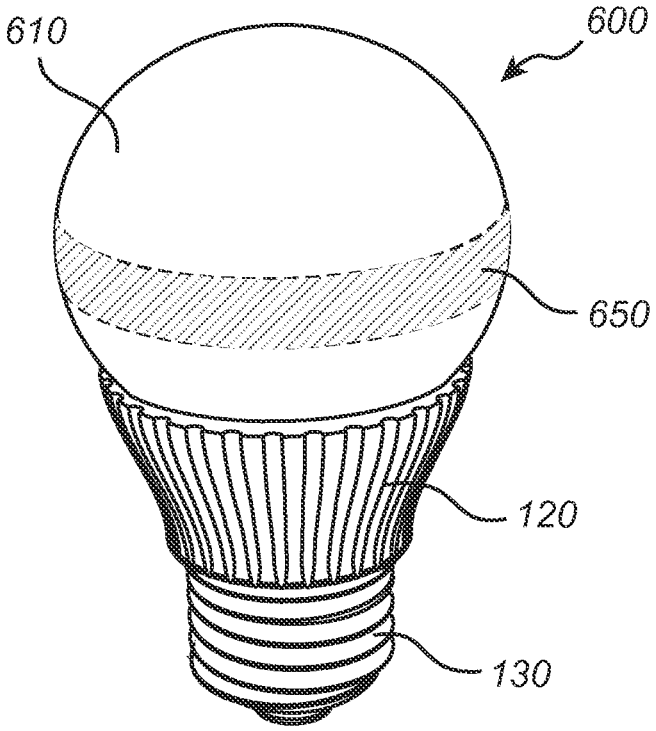
FIG. 6 is a schematic perspective side view of an embodiment of a lighting device according to the present inventive concept.

According to an embodiment of the lighting device, described with reference to FIG. 6 which is a side schematic side view of a lighting device 600, the lighting device 600 comprises a bulb 610 which is attached to a base 120. The base 120 is attached with a cap 130 for engaging with a socket. Further, control means arranged for detecting a position in relation to the base of a point of reference being movably arranged on the lighting device is here realized by providing a sensor area 650 on the inside or outside of the bulb 610. The sensor area may comprise a capacitive touch sensor, or alternatively a non-contact sensor. The sensor area 650 is here arranged on the inside of the bulb 610 by depositing a ring-shaped layer which acts as a resistor. Preferably, this layer, i.e. sensor area 650, is transparent. A suitable material for this is ITO (indium-tin-oxide). The layer is arranged to have a predetermined resistance per unit of length around the perimeter of the ring. In an alternative embodiment, the ring-shaped layer forming sensor area 650 is arranged having a meandering structure to increase the resistance of the layer. The sensor area 650 is further arranged in electrical contact with a control circuitry arranged in the cap 130. That is, at a number of locations along the perimeter of the ring-shaped layer, a connection is made (e.g. by means of thin wires, not shown). These connections are fed to a control chip (e.g. a QT510 from Quantum) included in the control circuitry. The control chip is arranged to measure and process the location of an object, like a hand or finger, close to the ring-shaped layer. Thereby, the control circuitry can adjust the lighting settings in response to the detected position of a users hand or finger, or in response to a direction of movement (of a hand or finger).

Instead of depositing the layer on the inside of the bulb, it can also be present on a transparent foil which then is assembled such as to be located inside the bulb.

In an embodiment of the lighting device, the sensor area comprises a sub-structure of various electrodes. Further, in embodiments of the lighting device, a second sensor area is arranged on top of the bulb to sense a push action.

According to an embodiment of the lighting device, the lighting device is augmented with an indicator indicating the setting. Such an indicator is in an embodiment a colored pattern arranged on the heat sink together with a mark on the bulb denoting the orientation of the bulb with respect to the colored pattern. In an alternative embodiment, the indicator is a display, which is embedded in the base or any suitable position.

According to an embodiment of the lighting device, the present inventive concept enables the lighting device to emit a range of colors in response to the horizontal, vertical position or rotation with respect to the base of the reference point, e.g. rotation of the bulb with respect to the base, while pushing or pulling the bulb with respect to the base implies changing the saturation of the light provided by the lighting device. As yet another example of the light effects which can be achieved, the light source here comprises Red, Green and Blue LEDs. The enabled color gamut is thus obtained by combining Red, Green and Blue light. Rotation of the bulb then implies changing color (hue). Other suitable color combinations of the LEDs of the light source are e.g. combining any of Red, Amber, Green, Cyan, Blue, and White LEDs.

According to an embodiment of the lighting device, the bulb is detachable from the lighting device, such that it can be replaced by another bulb having a different shape or a different optical effect, e.g. by providing a different appearance or a different light pattern. The light emission can be made isotropic, which is typical for an incandescent bulb, or directional, which is typical for a spot light.

The function of the bulb in this case is not only to prevent being blinded by the light of the bright LEDs but also to shape the direction the light is emitted into. This shaping can be done by giving the bulb a certain profile. In this manner the light effect from the lighting device can be personalized. For example, in this way a retrofit LED based lighting device can be adapted for use in a lamp shade or, after replacing the bulb with a different type of bulb, be used in a chandelier.

The person skilled in the art realizes that the present invention by no means is limited to the preferred embodiments described above. On the contrary, many modifications and variations are possible within the scope of the appended claims.

The invention claimed is:

1. A lighting device comprising:

at least one light source for providing light;

an envelope encompassing said light source;

a base to which said envelope is engaged;

a control means for adjusting the lighting settings of said lighting device, wherein said control means are arranged for detecting a position in relation to said base of a point of reference being movably arranged on said lighting device, and wherein said lighting settings are adjusted in response to said detected position; and a control element to which said reference point is associated, wherein said control element is a capacitive touch sensor or non-contact sensor, wherein said capacitive touch sensor or said non-contact sensor is arranged by means of a transparent conductor on an inner or outer side of said envelope, and wherein the at least one light source is disposed at a distance from said envelope such that said at least one light source is remote from said control element.

2. A lighting device according to claim 1, wherein said detected position is detected vertically, horizontally, or as a rotation about a central symmetry axis of the lighting device, or as any combination thereof.

3. A lighting device according to claim 2, wherein said envelope is movably engaged with said base.

4. A lighting device according to claim 3 wherein said envelope further comprises an inner envelope arranged for encompassing said light source.

5. A lighting device according to claim 4, wherein an optical layer is arranged on said inner envelope, wherein said optical layer is one of a remote phosphor layer, a segmented remote phosphor layer, and a micro-structure.

6. A lighting device according to claim 5, wherein said envelope is releasably engaged with said base.

7. A lighting device according to claim 1, wherein the at least one light source is disposed substantially at a symmetry axis of said envelope.

8. A lighting device according to claim 1, wherein said envelope is spherically-shaped.

9. A lighting device according to claim 1, wherein said envelope fully encloses the at least one light source.

* * * * *